US007367784B2

(12) United States Patent
No et al.

(10) Patent No.: US 7,367,784 B2
(45) Date of Patent: May 6, 2008

(54) OIL SUPPLY DEVICE FOR COMPRESSOR IN REFRIGERATING SYSTEM

(75) Inventors: Cheal-Ki No, Changwon-shi (KR); Kee-Joo Kim, Changwon-shi (KR); Jai-Seong Sim, Masan-shi (KR)

(73) Assignee: LG Electronics Inc., Seoul (KR)

( * ) Notice: Subject to any disclaimer, the term of this patent is extended or adjusted under 35 U.S.C. 154(b) by 743 days.

(21) Appl. No.: 10/484,698

(22) PCT Filed: Jul. 28, 2001

(86) PCT No.: PCT/KR01/01288

§ 371 (c)(1),
(2), (4) Date: May 20, 2004

(87) PCT Pub. No.: WO03/012297

PCT Pub. Date: Feb. 13, 2003

(65) Prior Publication Data

US 2004/0208758 A1 Oct. 21, 2004

(51) Int. Cl.
*F04B 39/02* (2006.01)

(52) U.S. Cl. ..... 417/372; 184/6.18

(58) Field of Classification Search ..... 417/372; 184/6.16, 6.18

See application file for complete search history.

(56) References Cited

U.S. PATENT DOCUMENTS 3,182,901 A * 5/1965 Solomon ..... 417/372
6,450,785 B1 * 9/2002 Dellby et al. ..... 184/6.18

FOREIGN PATENT DOCUMENTS

| | | |
|---|---|---|
| GB | 768058 | 2/1957 |
| JP | 60119389 A | 6/1985 |
| WO | WO-93/22557 A1 | 11/1993 |
| WO | WO-00/01949 A1 | 1/2000 |

* cited by examiner

*Primary Examiner*—Michael Koczo, Jr.
(74) *Attorney, Agent, or Firm*—McKenna Long & Aldridge LLP

(57) ABSTRACT

Oil supply device (130) for a compressor in a refrigerating system including a cylindrical piece (131) fixed to a lower end of a crankshaft (110) for rotating together with the crankshaft, a propeller (132) fitted inside of the piece for making oil to rise by a relative movement with the piece (131), and rotation prevention means (141) fitted to a bottom end of the propeller (132) for prevention of rotation of the propeller, thereby supplying an adequate amount of refrigerant oil even if the compressor, operative at a low, as well as a high speed, is operated at the low speed.

19 Claims, 7 Drawing Sheets

OIL SUPPLY DEVICE FOR COMPRESSOR IN REFRIGERATING SYSTEM

TECHNICAL FIELD

The present invention relates to a compressor in a refrigerating system, and more particularly, to an oil supply device for a compressor in a refrigerating system, which can supply an adequate amount of refrigerant oil even if the compressor, operative at a low, as well as a high speed, is operated at the low speed.

BACKGROUND ART

In general, the compressor in a refrigerating system compresses a working fluid passed through an evaporator in a refrigerator or an air conditioner, to supply refrigerant to a condenser. A system of a related art reciprocating type compressor will be explained with reference to FIGS. 1-3B. FIG. 1 illustrates an overall system of a related art reciprocating type compressor in a refrigerating system, schematically.

Referring to FIG. 1, the related art reciprocating type compressor is placed in a space enclosed by a lower shell 2 and an upper shell 1. The compressor is provided with a motor part for generating a rotating force as the motor part has a current applied thereto, a compression part for compressing the working fluid by the rotating force from the motor part, and an oil supply part for supplying refrigerant oil to reduce friction in a mechanical part and cool down the heated mechanical part. The motor part is provided with a stator 21 for receiving a current to generate an electromagnetic force, and a rotor 22 for generating a rotating force from the electromagnetic force of the stator. The compression part is provided with a connecting rod 31 for converting a rotating movement into a linear reciprocating movement, and a piston 32 in a cylinder block for compressing the working fluid by the connecting rod. The oil supply part is provided with a crankshaft 110 and an oil supply device 120, wherein the connecting rod 31 has one end pin coupled to an eccentric part 111 on a top of the crankshaft, and the other end pin coupled to the piston 32. Accordingly, the connecting rod 31 converts the rotating movement of the crankshaft to a linear movement of the piston.

There is an oil plate (not shown) at a lower part of the lower shell filled with refrigerant oil, with a lower end of the oil supply device 120 submerged in the refrigerant oil. There is a hermetic terminal 11 and a cluster 12 at one side of the lower shell 2 for connecting the stator 21 to an external power. The cluster 12 has a plurality of lead wires 13 branched from the stator 21 fixed by terminals (not shown), which are connected with a plurality of pins passed through the hermetic terminal 11.

The oil supply part will be explained with reference to FIGS. 2-3B. FIG. 2 illustrates a front view of the oil supply part for the compressor in a refrigerating system, FIG. 3A illustrates a section of a piece press fit in a lower end of the crankshaft in FIG. 2, and FIG. 3B illustrates a front view of the oil supply device in FIG. 2, an insert member fitted in the piece.

The oil supply part 100 is provided with a crankshaft 110 and an oil supply part 120. The crankshaft 110 has an eccentric part 111 fitted eccentric from a shaft center, a weight balance 112 under the eccentric part 111 for prevention of vibration during rotation, and a shaft part 113 having a refrigerant oil rising passage under the weight balance 112. There is an oil hole 113*b* in the middle of length of the shaft part 113 in communication with an outside of the shaft part 113, and a helical oil groove 113*a* along an outer circumference of the shaft part 113 extended from the oil hole 113*b* to the eccentric part 111 on top of the crankshaft. There is a drill hole 113*c* in communication with the oil hole 113*b*, formed lengthwise eccentric from an axis of the shaft part 113.

According to this, when the crankshaft is rotated, the refrigerant oil introduced into the drill hole 113*c* by a centrifugal force of the oil supply device 120 flows to the oil groove 113*a* through the oil hole 113*b*, and is sprayed onto a mechanical part as the refrigerant oil reaches the eccentric part 111 through the oil groove 113*a*. The refrigerant oil sprayed thus lubricates the compressor, and absorbs heat generated during operation of the compressor. This sprayed refrigerant oil prevents the compressor from suffering damage caused by a high temperature and friction.

There is a gas hole 113*d* in one side of the drill hole 113*c* opened in a point of a circumference of the shaft part 113 having a greatest distance to the drill hole 113*c* for discharging gas formed when the refrigerant oil is moved upward and outside of the crankshaft 110 as the oil supply part is rotated.

In the meantime, the oil supply device 120 for pumping the refrigerant oil by using the centrifugal force has a cylindrical piece 131 inserted in a lower end of the shaft part 113 of the crankshaft 110, and an insert member 122 fitted in the piece 131 for forming a rising passage of the refrigerant oil.

The foregoing oil supply device 120 in the lower end of the rotating crankshaft 110 rotates together with the crankshaft, when the refrigerant oil is pumped to the drill hole 113*c* as the refrigerant oil flows upward through the insert member in the oil supply device 120 by the centrifugal force, and, therefrom, to the oil groove 113*a* through the oil hole 113*b*. Then, the refrigerating oil lubricates a journal bearing (not shown) as the refrigerant oil flows upward along the oil groove 113*a*, and, at the end, moves up to the eccentric part 111 and is sprayed onto the mechanical part in the shell 1 and 2. The refrigerant oil sprayed thus is recovered by the oil plate at a lower part.

In the meantime, in order to reduce a power consumption of a refrigerating system, currently a pole changing, or BLDC motor, operative at a low speed, as well as at a high speed, is widely used as a compressor motor. However, the oil supply device provided for a high speed operation (approx. 3600 rpm) can not supply the refrigerant oil smoothly during a low speed operation (approx. 1800 rpm). That is, as the centrifugal force that is generated by the rotation of the oil supply device to move the refrigerant oil upward drops sharply when the compressor is operated at the low speed, the oil supply part can not supply the refrigerant oil, properly. Eventually, the compressor is involved in an excessive wear of the mechanical part, with a substantial reduction of lifetime of the compressor and an increased noise, as the compressor has a reduced performance of a heat dissipation, and reduced supply of the refrigerant oil.

DISCLOSURE OF INVENTION

Accordingly, the present invention is directed to an oil supply device for a compressor in a refrigerating system that substantially obviates one or more of the problems due to limitations and disadvantages of the related art.

An object of the present invention is to provide an oil supply device for a compressor in a refrigerating system, which can supply refrigerant oil smoothly during a low speed operation of the compressor.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. To achieve these and other advantages and in accordance with the purpose of the present invention, as embodied and broadly described, the oil supply device for a compressor in a refrigerating system includes a cylindrical piece fixed to a lower end of a crankshaft for rotating together with the crankshaft, an insert member fitted inside of the piece for making oil to rise by a relative movement with the piece, and rotation prevention means fitted to a bottom end of the insert member for prevention of rotation of the insert member.

The rotation prevention means includes an elastic member having one end fixed to a bottom end of the insert member, and a rotation prevention part for prevention of rotation of the elastic member.

The rotation prevention means includes a holding bar having one end held at a bottom end of the insert member, and a rotation preventer for holding the holding bar for prevention of rotation of the holding bar.

The elastic member is a conical coil spring having a lower part diameter greater than an upper part diameter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 4:
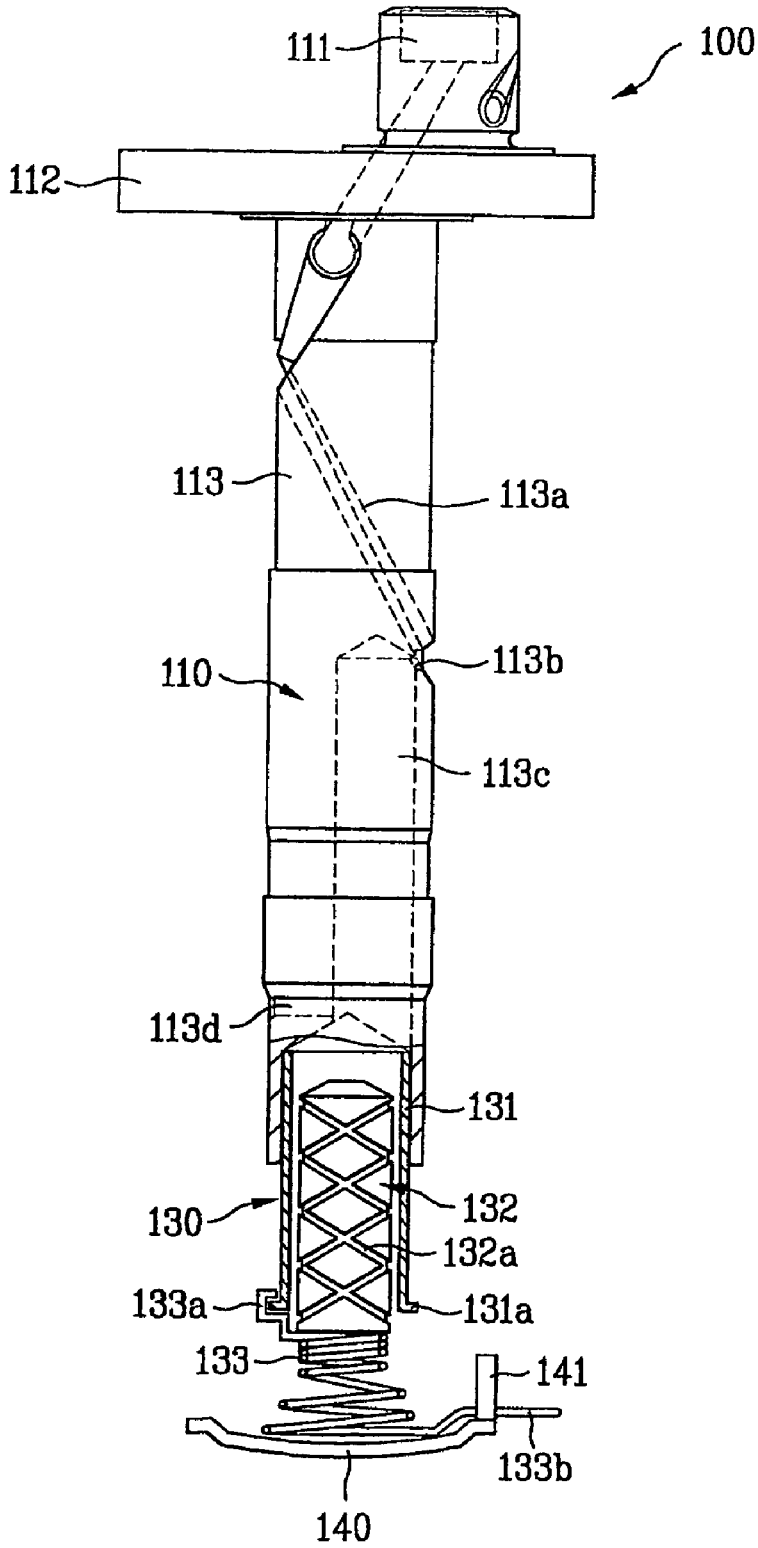
FIG. 4 illustrates a section of an oil supply part for a compressor in a refrigerating system in accordance with a preferred embodiment of the present invention.

Reference will now be made in detail to the preferred embodiments of the present invention, examples of which are illustrated in the accompanying drawings FIGS. 4-7. FIG. 4 illustrates a section of an oil supply part for a compressor in a refrigerating system in accordance with a preferred embodiment of the present invention.

Figure 8:
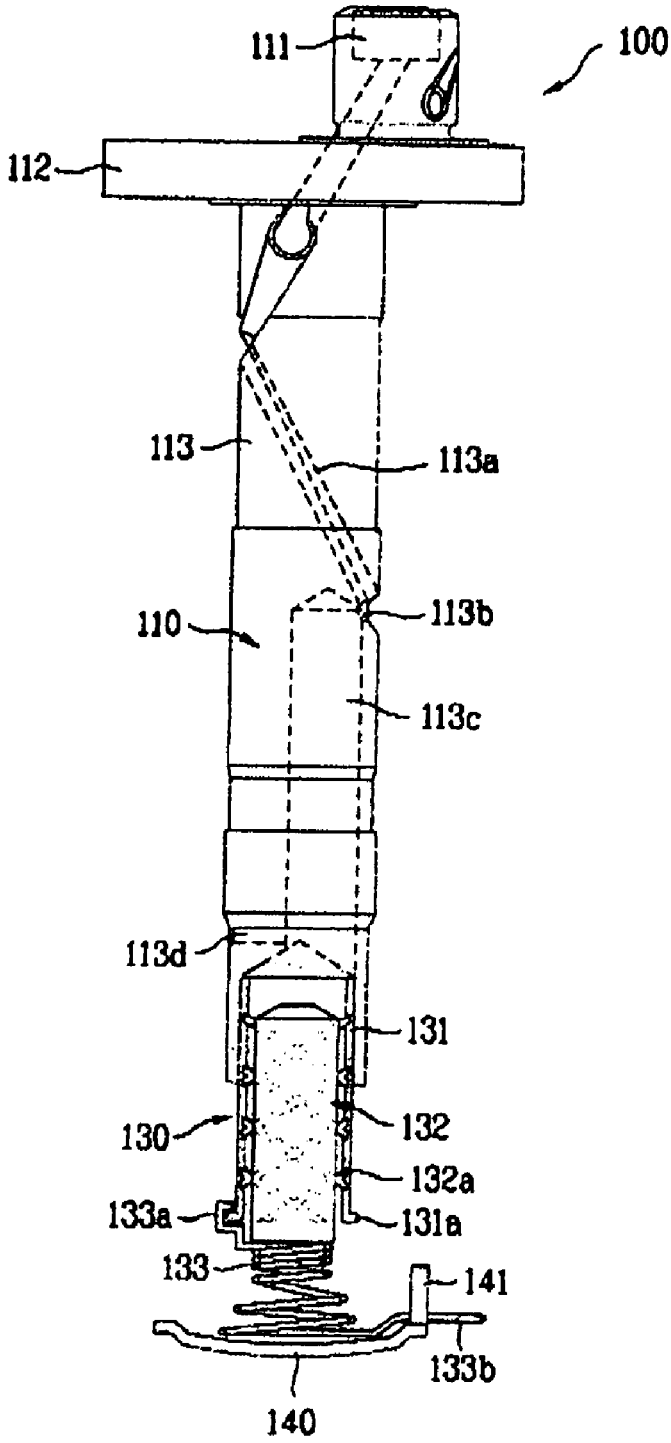
FIG. 8 illustrates a section of an oil supply part for a compressor in a refrigerating system in accordance with a preferred embodiment of the present invention.

Referring to FIG. 4, the oil supply part 100 in a refrigerating system includes a crankshaft 110 and an oil supply device 130, wherein the crankshaft 110 has an eccentric part 111, a weight balance 112, and a shaft part 113. The crankshaft is press fit in a center part of the rotor 22 to rotate as the rotor rotates. The oil supply device 130 is disposed at a lower end of the crankshaft, and includes a piece 131, an insert member 132, and rotation prevention means. The piece 131 is hollow and cylindrical with opened ends, and press fit in a lower end of the shaft part 113. The insert member 132 is fitted in the piece 131 such that an inside circumference of the insert member 132 and an outside circumference of the piece 131 form a clearance. The insert member 132 fitted thus has a plurality of helical grooves 132*a* in the outer circumference from a bottom end to a top end thereof, and it is preferable that two or three of the helical grooves 132*a* are formed in the insert member 132 for an optimal flow of the refrigerant oil. Of course, instead of the helical grooves in the outside circumference of the insert member, the helical groove may be formed in an inside circumference of the piece 131, as illustrated in FIG. 8.

In the meantime, the rotation prevention means is fixed at a bottom end of the insert member 132, including an elastic member 133 having one end fixed to the bottom end of the insert member, and a rotation prevention part 141 for prevention of rotation of the elastic member. In this instance, a holding part may be formed at a bottom end of the insert member 132 for inserting, and fixing the top end of the elastic member 133. The rotation prevention part is projected from a dish 140 under the elastic member for receiving dirt.

Figure 1:
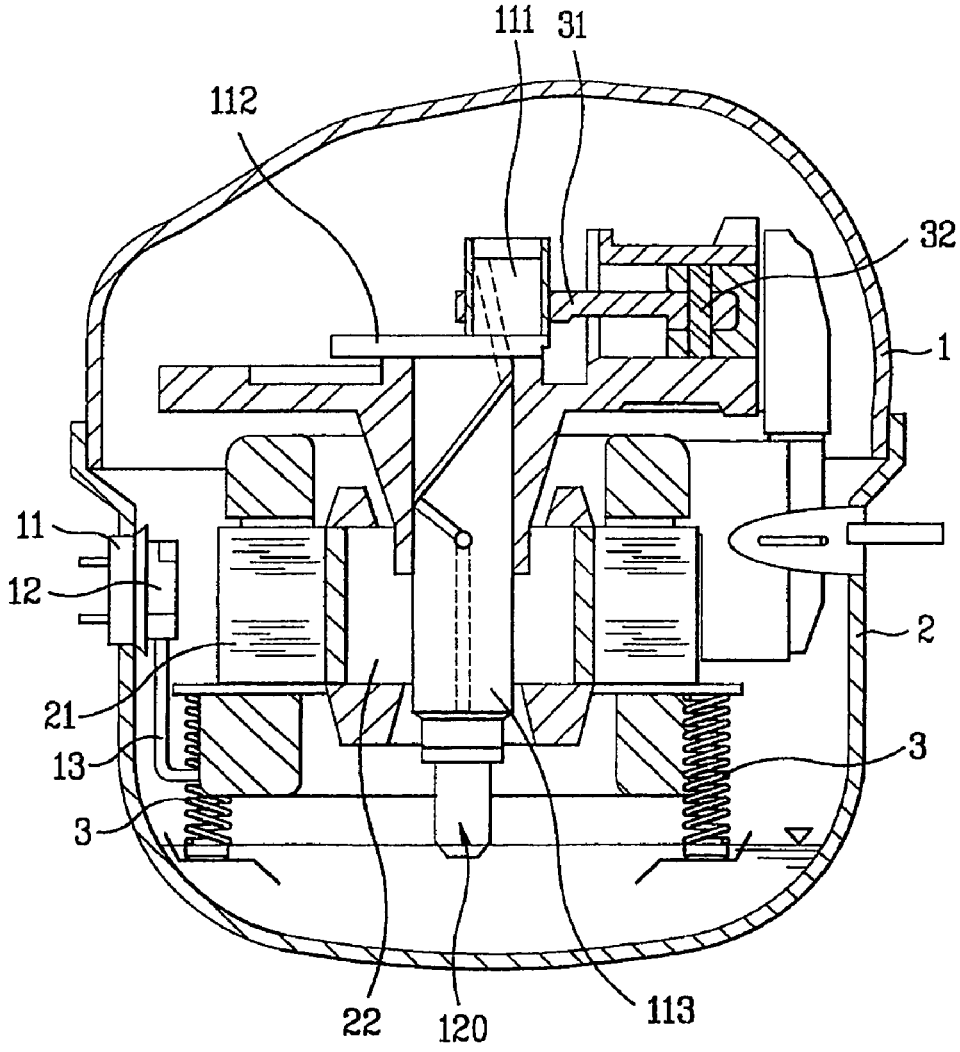
FIG. 1 Related Art
FIG. 1 illustrates an overall system of a related art reciprocating type compressor in a refrigerating system, schematically.
Figure 2:
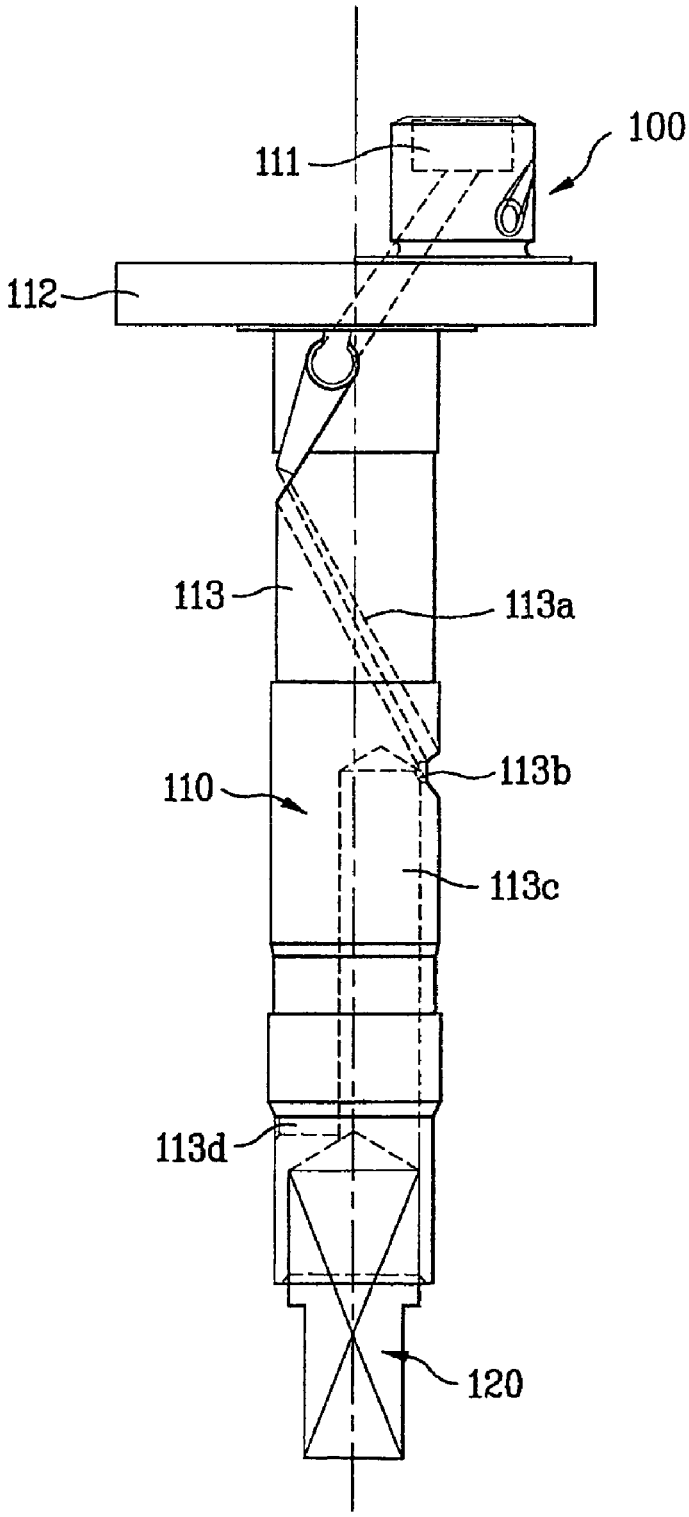
FIG. 2 Related Art
FIG. 2 illustrates a front view of the oil supply part for the compressor in a refrigerating system in FIG. 1.
Figure 3A:
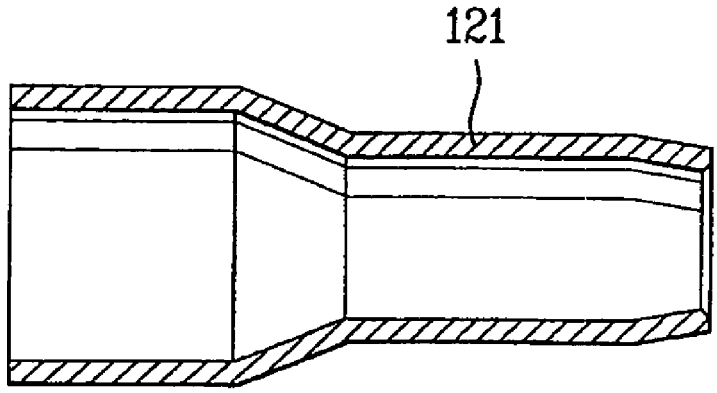
FIG. 3A Related Art
FIG. 3A illustrates a section of a piece press fit in a lower end of the crankshaft in FIG. 2.
Figure 3B:
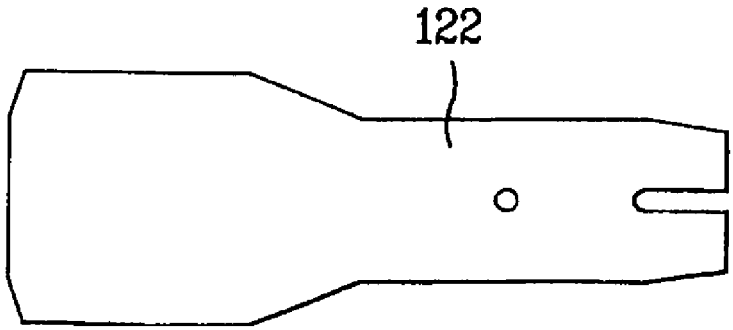
FIG. 3B Related Art
FIG. 3B illustrates a front view of the oil supply device in FIG. 2, an insert member fitted in the piece.

Thus, since the insert member 132 is fixed by the elastic member at the bottom end thereof to be set with a fixed gap to the piece 131, the insert member 132 does not rotate even if the piece 131 rotates. The insert member and the piece can be damaged if a rotational axis of the piece 131 is disturbed by an external force or vibration during rotation of the piece 131. In order to prevent such damage it is preferable that the elastic member 133 has an outward elasticity with respect to the rotating axis of the piece 131, such as a coil spring. Moreover, it is more preferable that the elastic member is a conical coil spring having an upper part diameter smaller than a lower part diameter, for a wide range of vibration absorption that occurs in the direction of a rotational axis of the insert member 132 when the refrigerant oil flows upward through the helical groove 132*a* during rotation of the piece 131. The foregoing elastic means 133 is fixed to the bottom end of the insert member 132 such that an helical direction of the elastic member 133 corresponds with the rotational direction of the piece 131 when the elastic member is seen from the bottom end of the elastic member, for preventing the insert member 132 from falling off the elastic member 133 as the elastic member is fastened during the piece 131 is rotated. Furthermore, it is preferable that the elastic member 133 fixed to the insert member 132 has a wire diameter smaller than the compressor support springs 3 shown in FIG. 1, for supporting the mechanical part of the compressor from below and attenuating vibration occurred at the compressor. This minimizes the influence of the vibration on the elastic member 133 fixed to the insert member 132 even if there is excessive vibration produced by the compressor that affects the elastic member 133 fixed to the insert member 132.

In the meantime, there is an annular rim 131*a* projected outward from a bottom end of an outside circumference of the piece 131 for preventing buckling of the bottom end of the piece 131 when the piece 131 is pressed into the shaft part 113. There is a holder 133*a* at one end of the elastic member 133 corresponding to the rim 131*a*, that allows for engagement of the holder 133*a* with the rim 131*a*. This engagement fixes the elastic member 133 such that there is a more stable connection of the insert member 132 fixed to the top end of the elastic member 133. Because it is required that the holder 133*a* does not rotate even if the rim 131*a* rotates, the holder 133*a* is required to have a certain clearance between the rim 131*a* when the holder is engaged with the rim. Consequently, it is preferable that the holder has a "⊂" form for preventing the holder from falling off the rim 131*a*.

Since a lower part of the oil supply device is submerged in refrigerant oil, even if the rim 131*a* comes into contact with the holder 133*a* while rim 131*a* rotates, there is no noise generated. Though the bottom end of the elastic member 133 may be fixed to the dirt dish 140, one embodiment in which the elastic member 133 is fixed to the dirt dish 140 will be explained. The elastic member has an outward extension 133*b* at a bottom end, and the dirt dish 140 has a rotation preventer 141 for holding the extension 133*b*. The extension 133*b* has a '_' form extended outward in a direction of the helix of the coil spring. The rotation preventer 141, which is projected upward, may merely hold the extension 133*b* or press against the extension 133*b* to stop the extension 133*b*.

In the foregoing oil supply device 130, as the insert member 132 is kept stationary when the piece 131 is rotated, the insert member 132 makes a relative movement with piece 131. Then, the refrigerant oil flows upward through the helical groove 132*a* by a centrifugal force caused by the relative movement of the piece 131 and the insert member 132, and a viscosity of the refrigerant oil. Then, the refrigerant oil introduced into the drill hole 113*c* through the helical groove 132*a* reaches to the oil hole 113*b*, and, in continuation, is sprayed onto the mechanical part after the refrigerant oil is moved to the eccentric part 111 while the refrigerant oil lubricates the journal bearing outside of the shaft part 113. According to this, an adequate amount of refrigerant oil can be pumped through the helical groove 132*a* even in a low speed operation of the compressor.

Figure 5:
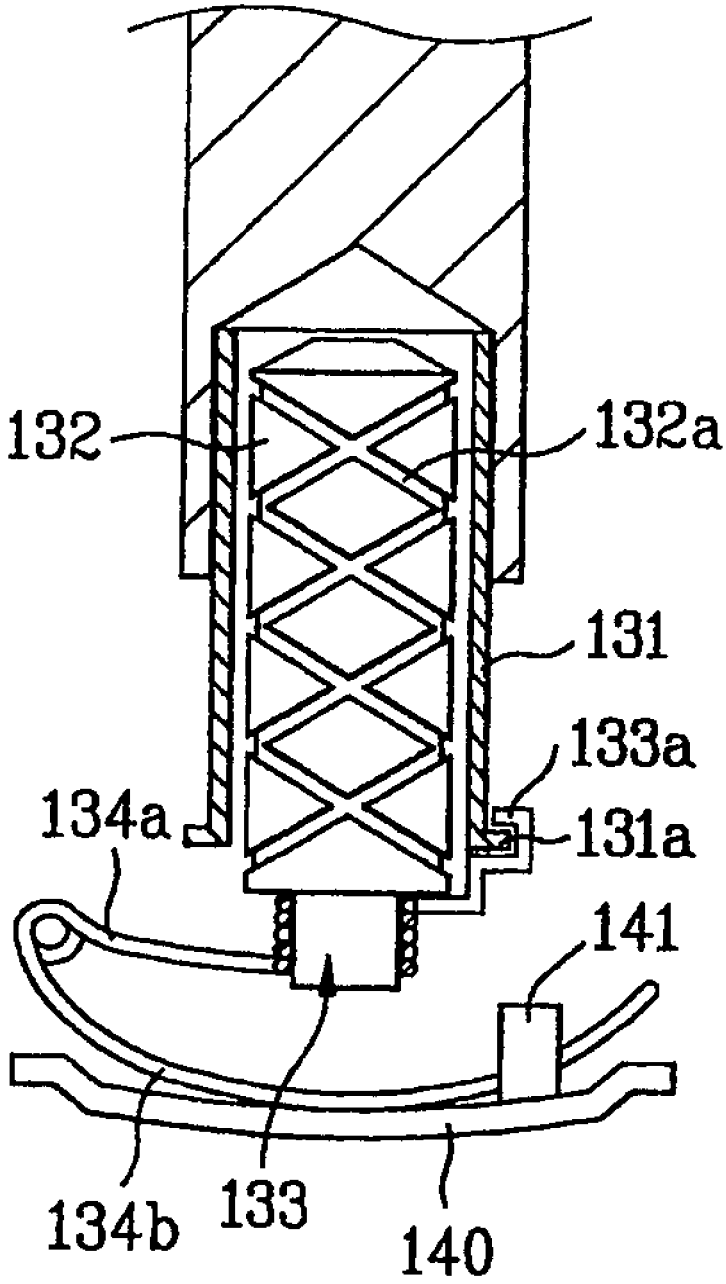
FIG. 5 illustrates a front view of an oil supply device in accordance with a second preferred embodiment of the present invention.

FIG. 5 illustrates a front view of an oil supply device in accordance with a second preferred embodiment of the present invention. Since a piece and an insert member of the second embodiment have the same structure and operation with the first embodiment, no more explanation of the same will be given.

An elastic member, having a top end fixed to a bottom end of the insert member, has an extension 133*b* extended from the bottom end of the elastic member The extension 133*b* has a first extension 134*a* extended outward from the bottom end, and a second extension 134*b* bent backward and extended to an under side of the first extension 134*a* in an arc from an external end of the first extension 134*a*. According to this, the second extension 134*b* is held by the rotation preventer 141 projected upward from the dirt dish, to prevent rotation of the elastic member 133 while the piece 131 rotates. The first and second extensions 134*a* and 134*b* absorb a wider range of vibration transmitted from the insert member 132 while the piece 131 is rotated.

Figure 6:
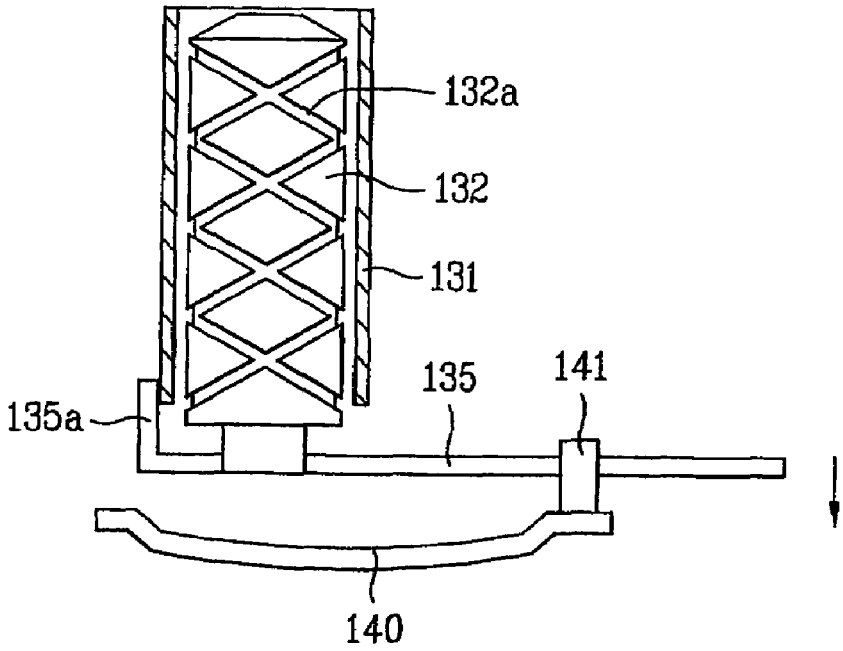
FIG. 6 illustrates a front view of an oil supply device in accordance with a third preferred embodiment of the present invention; and, FIG. 7 illustrates a side view of the rotation prevention part in FIG. 6.
Figure 7:
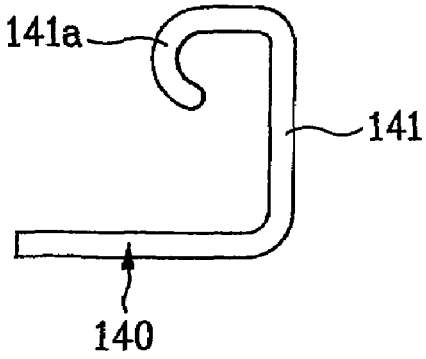

FIG. 6 illustrates a front view of an oil supply device in accordance with a third preferred embodiment of the present invention, and FIG. 7 illustrates a side view of a grip of the rotation prevention part in FIG. 6. In the oil supply device of the third embodiment, since an insert member 132 has the same structure and operation with the first embodiment, no more explanation of the same will be given.

FIGS. 6 and 7 illustrate a cylindrical piece of the third embodiment, press fit and fixed to a bottom end of a crankshaft, without the rim at a bottom end of an outer circumference of the piece. There is a holding bar 135 inserted in the bottom end of the insert member 132, with one end bent at a right angle to a length of the holding bar 135. There is a rotation preventer 141 projected from the dirt dish 140. As shown in FIG. 7, the rotation preventer 141 has a grip 141*a* having a "⊂" form opened downward at one end thereof in a side view. As the other end of the holding bar 135 is inserted and held at the grip 141*a* of the rotation preventer 141, the insert member 132 held at the holding bar 135 is made stationary. After the insert member is made stationary, the compressor is set while the piece 131 is inserted around the insert member 132. When the compressor is set, a bent part 135*a* of the holding bar 135 comes to press a bottom end of the piece 131. Then, as the piece 131 is rotated, the piece presses the holding bar such that the other end of the holding bar 135 comes out of the grip 141*a*. Even if the holding bar 135 comes out of the grip 141*a*, rotation of the insert member 132 can be prevented by the rotation prevention part 141 formed on the dirt dish. As there is refrigerant oil rising between the insert member 132 and the piece 131 while generating a centrifugal force when the piece 131 is rotated, a gap is maintained between the insert member 132 and the piece 131, thereby preventing friction between the two. Accordingly, an adequate amount of refrigerant oil can be supplied even if the compressor is operated at a lower speed by the centrifugal force generated by the relative rotation between the insert member 132 and the piece 131, and the viscosity of the refrigerant oil, permitting to prevent wear of the compressor and damage caused by temperature rise of the mechanical part during a lower speed operation of the compressor.

INDUSTRIAL APPLICABILITY

As has been explained, in a reciprocating type compressor which is operative both at a high speed and a low speed, the oil supply device for a compressor in a refrigerating system of the present invention can supply an adequate amount of refrigerant oil to the eccentric part on top of the shaft part, thereby improving a reliability of the compressor as wear and damage of various components of the compressor can be prevented and a heat generated from the mechanical part can be dissipated.

The invention claimed is:

1. An oil supply device for a compressor in a refrigerating system comprising:

a cylindrical piece fixed to a lower end of a crankshaft for rotating together with the crankshaft;

an insert member fitted inside of the piece adapted to make oil rise by a relative movement with the piece, wherein the piece has plural helical grooves on an inside circumference or the insert member has plural helical grooves disposed on an outside surface of the insert member; and rotation prevention means fitted to a bottom end of the insert member for prevention of rotation of the insert member.

2. An oil supply device as claimed in claim 1, wherein the rotation prevention means includes;

an elastic member having one end fixed to a bottom end of the insert member; and a rotation prevention part for prevention of rotation of the elastic member.

3. An oil supply device as claimed in claim 2, wherein the rotation prevention part is projected from a dirt dish provided under the elastic member.

4. An oil supply device as claimed in claim 1, wherein the helical grooves are two or three.

5. An oil supply device as claimed in claim 2, wherein the elastic member is a coil spring.

6. An oil supply device as claimed in claim 5, wherein the coil spring is conical with a lower part diameter greater than an upper part diameter.

7. An oil supply device as claimed in claim 5, wherein the coil spring is fitted such that the coil spring has a helix direction the same with a direction of rotation of the piece when the coil spring is seen from the bottom end side thereof for fastening the spring when the piece is rotated, for preventing the insert member held at the spring from falling off the piece.

8. An oil supply device as claimed in claim 5, wherein the coil spring has a diameter smaller than compressor support springs fitted at a lower part of the compressor, for absorbing vibration occurred as the compressor is rotated.

9. An oil supply device as claimed in any one claim in claims 5-8, wherein the coil spring has an extension from a bottom end for prevention of rotation of the coil spring as the extension is held by the rotation prevention part.

10. An oil supply device as claimed in claim 9, wherein the extension has "_" form.

11. An oil supply device as claimed in claim 2, wherein the elastic member has an extension that includes:

a first extension extended outward from the bottom end of the elastic member, and a second extension bent backward and extended to an under side of the first extension in an arc from an external end of the first extension.

12. An oil supply device as claimed in claim 2, wherein the piece includes;

an annular rim projected outward from an outer circumference of a bottom end of the piece for prevention of buckling of the piece when the piece is press fit into a lower end of the crankshaft.

13. An oil supply device as claimed in claim 12, wherein the elastic member includes a holder at one end for engagement with the rim on the piece, for preventing the insert member from falling off the piece when the piece rotates.

14. An oil supply device as claimed in claim 13, wherein the holder has a "⊂ " form in correspondence to the rim.

15. An oil supply device as claimed in claim 1, wherein the rotation prevention means includes:

a holding bar having one end held at a bottom end of the insert member, and a rotation preventer for holding the holding bar for prevention of rotation of the holding bar.

16. An oil supply device as claimed in claim 15, wherein the rotation preventer is projected from a dirt dish provided under the holding bar.

17. An oil supply device as claimed in claim 16, wherein the rotation preventer includes:

a grip of a "⊂" form opened downward at one end thereof in a side view, for preventing the insert member from falling off the piece when the holding bar is inserted in the grip, and a mechanical part of the compressor is set.

18. An oil supply device for a compressor in a refrigerating system comprising:

a cylindrical piece fixed to a lower end of a crankshaft for rotating together with the crankshaft, wherein the piece includes:

an annular rim projected outward from an outer circumference of a bottom end of the piece adapted to prevent buckling of the piece when the piece is press fit into a lower end of the crankshaft;

an insert member fitted inside of the piece adapted to make oil to rise by a relative movement with the piece; and rotation prevention means fitted to a bottom end of the insert member for prevention of rotation of the insert member.

19. An oil supply device for a compressor in a refrigerating system comprising:

a cylindrical piece fixed to a lower end of a crankshaft for rotating together with the crankshaft;

an insert member fitted inside of the piece adapted to make oil to rise by a relative movement with the piece; and rotation prevention means fitted to a bottom end of the insert member adapted to prevent rotation of the insert member, wherein the rotation prevention means includes:

a coil spring having one end fixed to a bottom of the insert member, and a rotation prevention part adapted to prevent rotation of the coil spring.

* * * * *